US005813263A

United States Patent [19]

Tokai

[11] Patent Number: 5,813,263

[45] Date of Patent: Sep. 29, 1998

[54] RAM POSITION SETTING METHOD AND RAM CONTROL UNIT FOR PRESS BRAKE

[75] Inventor: Shigeru Tokai, Ishikawa, Japan

[73] Assignee: Komatsu, Ltd., Tokyo, Japan

[21] Appl. No.: 917,746

[22] Filed: Aug. 27, 1997

Related U.S. Application Data

[63] Continuation of Ser. No. 619,509, Mar. 28, 1996, abandoned.

[30] Foreign Application Priority Data

Oct. 15, 1993 [JP] Japan ..... 5-258233

[51] Int. Cl.[6] ..... B21D 5/01

[52] U.S. Cl. ..... 72/21.4; 72/21.3; 72/389.4

[58] Field of Search ..... 72/21.4, 21.3, 72/389.4

[56] References Cited

U.S. PATENT DOCUMENTS

| | | | |
|---|---|---|---|
| 4,408,471 | 10/1983 | Grossard et al. | 72/21.4 |
| 4,797,831 | 1/1989 | Dressing et al. | 72/389.3 |

FOREIGN PATENT DOCUMENTS

| | | | |
|---|---|---|---|
| 2-39610 | 10/1990 | Japan . | |
| 6-134524 | 5/1994 | Japan | 72/21.4 |
| 6-154874 | 6/1994 | Japan | 72/21.4 |
| 6-154875 | 6/1994 | Japan | 72/21.4 |
| W088/01916 | 3/1988 | WIPO . | |

OTHER PUBLICATIONS

Japanese Patent Abstract Publication No. 02030327 A, dated Jan. 31, 1990, JUNJI et al.

Japanese Patent Abstract Publication No. 03090218 A, dated Apr. 16, 1991, Haruo.

Japanese patent Abstract Publication No. 03071922 A, dated Mar. 27, 1991, Kinshiro.

Japanese Patent Abstract Publication No. 03071923 A, dated Mar. 27, 1991, Kinshiro.

Japanese Patent Abstract Publication No. 04361831 A, dated Dec. 15, 1992, Naoto.

*Primary Examiner*—David Jones

*Attorney, Agent, or Firm*—Nikaido, Marmelstein, Murray & Oram LLP

[57] ABSTRACT

During the process of bending a workpiece, actual load exerted on the workpiece and displacement are sampled and the bending stress to displacement relationship is obtained from the sampling data and data on the actual thickness of the workpiece. From the bending stress to displacement relationship, a material characteristic value (e.g., yield stress) which indicates the condition of the material of the workpiece is obtained. Then, a bending angle correction amount is obtained from the material characteristic value, using a data table concerning the material characteristic value to bending angle relationship. From the bending angle correction amount thus obtained, a correction depth amount is obtained. The correction depth amount is added to a preset reference depth amount to obtain a final depth amount according to which bending is performed.

8 Claims, 8 Drawing Sheets

RAM POSITION SETTING METHOD AND RAM CONTROL UNIT FOR PRESS BRAKE

This application is a continuation of application Ser. No. 08/619,509 filed Mar. 28, 1996, now abandoned.

TECHNICAL FIELD

The present invention relates to ram position setting methods for a press brake and ram control units for a press brake in which these methods are used.

BACKGROUND ART

One known method for bending a sheet-like workpiece by the use of a bending machine such as a press brake is such that various items of information (e.g., workpiece conditions such as thickness and material, (upper and lower) bender conditions, and machine conditions) are input in an NC device; a depth amount for an upper or lower bender is determined based on the input information; and the ram is then operated with this depth amount so that a desired semi-finished (processing) product can be obtained.

In practice, even though a ram is operated based on a lot of information, variations in the thickness and characteristics of workpieces or different processing conditions often lead to a failure in obtaining a desired bending angle, so that bending angle errors are inevitable.

In order to achieve high-accuracy bending operation free from errors in bending angles due to variations in material etc., there have been proposed various control methods in which the position of the ram is controlled according to a final bending angle that is estimated from bending load to displacement data obtained during bending operation. One of such control methods is disclosed in Japanese Patent Publication (Kohyo Koho) 1-5001127(1989). According to this publication, the ram position to actual bending force relationship during bending operation and the ram position to actual bending force relationship when load is eliminated by slightly lifting the ram during the operation are obtained. Based on the data, a final depth position (i.e., a lower limit position for the ram) is computed to obtain a target bending angle.

The method disclosed in the above publication however imposes a problem. That is, the method requires slight lifting of the ram in the course of bending operation to once eliminate load, which makes the control of the ram complicated and prolongs the time required for bending operation.

The present invention has been made taking the above problems into account and one of the objects of the invention is therefore to provide ram position setting methods and ram control units for a press brake, the method and unit ensuring high-accuracy bending operation that is not affected by variations in the material of workpieces to be processed and that can be performed without lifting the ram in the course of the operation.

DISCLOSURE OF THE INVENTION

Having found the fact that a material characteristic value (e.g., yield stress) indicating a characteristic of the material of a workpiece being bent has a certain correlation with a bending angle for the workpiece, this correlation is utilized to accomplish the above object.

According to a first embodiment of the method of the invention, there is provided a ram position setting method for a press brake for bending a workpiece placed between a punch and die at a predetermined angle by lifting or lowering a ram, wherein the relationship between actual load exerted on the workpiece and displacement is first obtained during bending of the workpiece; a specific material characteristic value that indicates a characteristic of the material of the workpiece is then obtained from the actual load to displacement relationship; and a position for the ram is set based on the correlation between the material characteristic value and bending angle.

In the above ram position setting method having the first feature, the relationship between the actual load exerted on the workpiece and the displacement of the workpiece is first obtained during the bending operation performed with a punch and die. Then, a material characteristic value that indicates a characteristic of the material of the workpiece such as yield stress is obtained from this relationship. From the correlation between the material characteristic value and the bending angle, a position for the ram is determined.

According to a second embodiment of the method of the invention, there is provided a ram position setting method for a press brake for bending a workpiece placed between a punch and die at a predetermined angle by lifting or lowering a ram, wherein a specific material characteristic value that indicates a characteristic of the material of the workpiece is obtained from changes with time in actual load exerted on the workpiece during bending of the workpiece and a position for the ram is set based on the correlation between the material characteristic value and bending angle.

In the above ram position setting method having the second feature, a specific material characteristic value that indicates a characteristic of the material of the workpiece is obtained from changes with time in the actual load exerted on the workpiece while the workpiece is being bent with a punch and die, and a position for the ram is determined from the correlation between the material characteristic value and bending angle.

In this way, the position of the ram is automatically corrected according to a characteristic of the material of a workpiece to be processed so that high-accuracy bending free from the influence of variations in the material of workpieces can be ensured. In addition, there is no need to lift the ram in the course of the operation so that the control of the ram is not complicated and the time required for the operation can be lessened.

According to a first embodiment of the control unit of the invention, there is provided a ram control unit (its principle is shown in FIG. 1) for a press brake for bending a workpiece placed between a punch and die at a predetermined angle by lifting or lowering a ram, the ram control unit comprising:

(a) reference depth amount setting means for setting a reference depth amount for the punch according to processing data for the workpiece which has been input;

(b) actual load detecting means for detecting actual load exerted on the workpiece during bending operation;

(c) displacement detecting means for detecting the displacement of the workpiece during bending operation;

(d) material characteristic value computing means for computing actual load to displacement data during bending operation from the output of the actual load detecting means and from the output of the displacement detecting means and for computing, from the actual load to displacement data, a specific material characteristic value which indicates a characteristic of the material of the workpiece being bent;

(e) correction depth amount computing means for computing, from the material characteristic value obtained by the material characteristic value computing means, a correction depth amount that corresponds to the material characteristic value;

(f) final depth amount computing means for computing a final depth amount for the punch by adding the correction depth amount obtained by the correction depth amount computing means to the reference depth amount; and (g) ram operating means for operating the ram based on the final depth amount obtained by the final depth amount computing means.

In the above ram control unit for a press brake having the first feature, during bending of a workpiece, the actual load exerted on the workpiece is detected by the actual load detecting means while the displacement of the workpiece being detected by the displacement detecting means. From the respective outputs of the actual load detecting means and the displacement detecting means, the actual load to displacement data during bending operation is calculated. From this actual load to displacement data, a material characteristic value which indicates a characteristic of the material of the workpiece being bent such as yield load is obtained. Then, a correction depth amount corresponding to the material characteristic value is calculated from the material characteristic value. The correction depth amount is added to a predetermined reference depth amount to obtain a final depth amount according to which the ram is operated.

According to a second embodiment of the control unit of the invention, there is provided a ram control unit for a press brake for bending a workpiece placed between a punch and die at a predetermined angle by lifting or lowering a ram, the ram control unit comprising:

(a) reference depth amount setting means for setting a reference depth amount for the punch according to processing data for the workpiece which has been input;

(b) actual load detecting means for detecting actual load exerted on the workpiece during bending operation at specified time intervals;

(c) material characteristic value computing means for computing changes with time in the actual load during bending operation from the output of the actual load detecting means, and for computing, from the changes with time in the actual load, a specific material characteristic value which indicates a characteristic of the material of the workpiece being bent;

(d) correction depth amount computing means for computing, from the material characteristic value obtained by the material characteristic value computing means, a correction depth amount that corresponds to the material characteristic value;

(e) final depth amount computing means for computing a final depth amount for the punch by adding the correction depth amount obtained by the correction depth amount computing means to the reference depth amount; and (f) ram operating means for operating the ram based on the final depth amount obtained by the final depth amount computing means.

In the above ram control unit for a press brake having the second feature, measurement time intervals are used in place of the displacement of the workpiece that is utilized in the first ram control unit for a press brake of the invention, so that the material characteristic value is calculated from changes with time in the actual load exerted on the workpiece.

According to a third embodiment of the control unit of the invention, there is provided a ram control unit for a press brake for bending a workpiece placed between a punch and die at a predetermined angle by lifting or lowering a ram, the ram control unit comprising:

(a) reference depth amount setting means for setting a reference depth amount for the punch according to processing data for the workpiece which has been input;

(b) actual load detecting means for detecting actual load exerted on the workpiece during bending operation;

(c) displacement detecting means for detecting the displacement of the workpiece during bending operation;

(d) material characteristic value computing means for computing actual load to displacement data during bending operation from the output of the actual load detecting means and from the output of the displacement detecting means; for computing bending stress to displacement data during bending operation from the actual load to displacement data and from preliminarily input thickness data on the workpiece; and for computing, from the bending stress to displacement data, a specific material characteristic value which indicates a characteristic of the material of the workpiece being bent;

(e) correction depth amount computing means for computing, from the material characteristic value obtained by the material characteristic value computing means, a correction depth amount that corresponds to the material characteristic value;

(f) final depth amount computing means for computing a final depth amount for the punch by adding the correction depth amount obtained by the correction depth amount computing means to the reference depth amount; and (g) ram operating means for operating the ram based on the final depth amount obtained by the final depth amount computing means.

In the above ram control unit for a press brake having the third feature, the actual load to displacement data during bending operation is calculated from the respective outputs of the actual load detecting means and displacement data detecting means like the first ram control unit of the invention, and from the actual load to displacement data and preliminarily input thickness data on the workpiece, the bending stress to displacement data during bending operation is calculated. Then, a material characteristic value (e.g., yield stress) that indicates a characteristic of the material of the workpiece being bent is obtained from the bending stress to displacement data.

According to a forth embodiment of the control unit of the invention, there is provided a ram control unit for a press brake for bending a workpiece placed between a punch and die at a predetermined angle by lifting or lowering a ram, the ram control unit comprising:

(a) reference depth amount setting means for setting a reference depth amount for the punch according to processing data for the workpiece which has been input;

(b) actual load detecting means for detecting actual load exerted on the workpiece during bending operation at specified time intervals;

(c) material characteristic value computing means for computing changes with time in the actual load during bending operation from the output of the actual load detecting means; for computing changes with time in bending stress during bending operation from the changes with time in the actual load and from preliminarily input thickness data on the workpiece; and for computing, from the changes with time in the bending stress, a specific material characteristic value which indicates a characteristic of the material of the workpiece being bent;

(d) correction depth amount computing means for computing, from the material characteristic value obtained by the material characteristic value computing means, a correction depth amount that corresponds to the material characteristic value;

(e) final depth amount computing means for computing a final depth amount for the punch by adding the correction depth amount obtained by the correction depth amount computing means to the reference depth amount; and (f) ram operating means for operating the ram based on the final depth amount obtained by the final depth amount computing means.

In the above ram control unit for a press brake having the forth feature, measurement time intervals are used in place of the displacement of the workpiece that is utilized in the third ram control unit, so that changes with time in the actual load exerted on the workpiece is calculated. From the changes with time in the actual load and preliminarily input thickness data on the workpiece, changes with time in the bending stress during bending operation is calculated. Then, a material characteristic value is obtained from the changes with time in the bending stress.

In this case, the thickness data may be a measured value obtained by an automatic thickness measuring device or may be input manually.

The correction depth amount computing means may be designed to calculate a bending angle correction amount from the material characteristic value obtained by the material characteristic value computing means and to calculate a correction depth amount from the bending angle correction amount.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a diagram showing the principle of a ram control unit for a press brake according to the invention;

FIG. 2 is a diagram showing a system structure according to one embodiment of the invention;

FIG. 3 is a sectional view of a device for measuring the displacement of a workpiece according to one embodiment of the invention;

FIG. 4 is a graph showing the relationship between yield stress and bending angles according to one embodiment of the invention;

FIG. 5(*a*) is a graph showing a stress-displacement curve according to one embodiment of the invention;

FIG. 5(*b*) is a graph showing how to obtain yield stress according to one embodiment of the invention;

FIG. 6 is a flow chart of ram control according to one embodiment of the invention; and FIG. 7 is a side view of an automatic thickness measuring device according to one example;

FIG. 8 is a graph concerning a material characteristic value according to another example.

BEST MODE FOR CARRYING OUT THE INVENTION

Referring now to the accompanying drawings, ram position setting methods and ram control units for a press brake will be described according to preferred embodiment of the invention.

Figure 1:
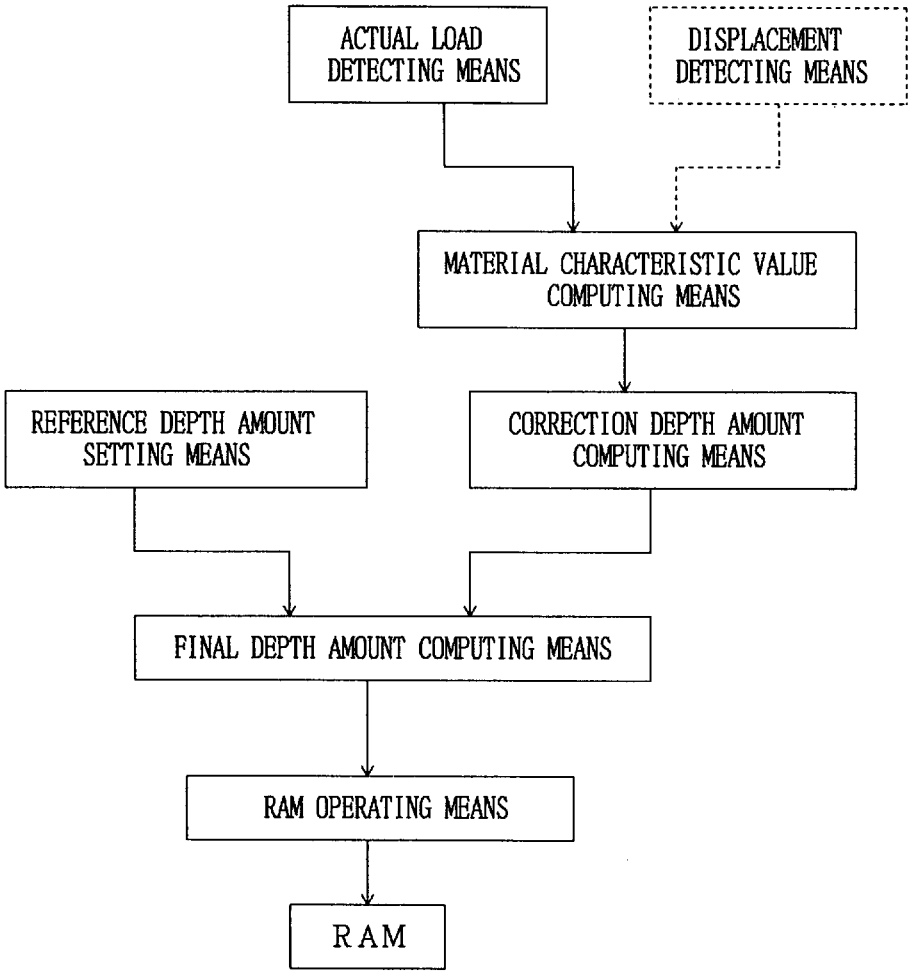
FIGS. 1 to 8 are illustrations associated with ram position setting methods and ram control units for a press brake according to preferred embodiments of the invention.
Figure 2:
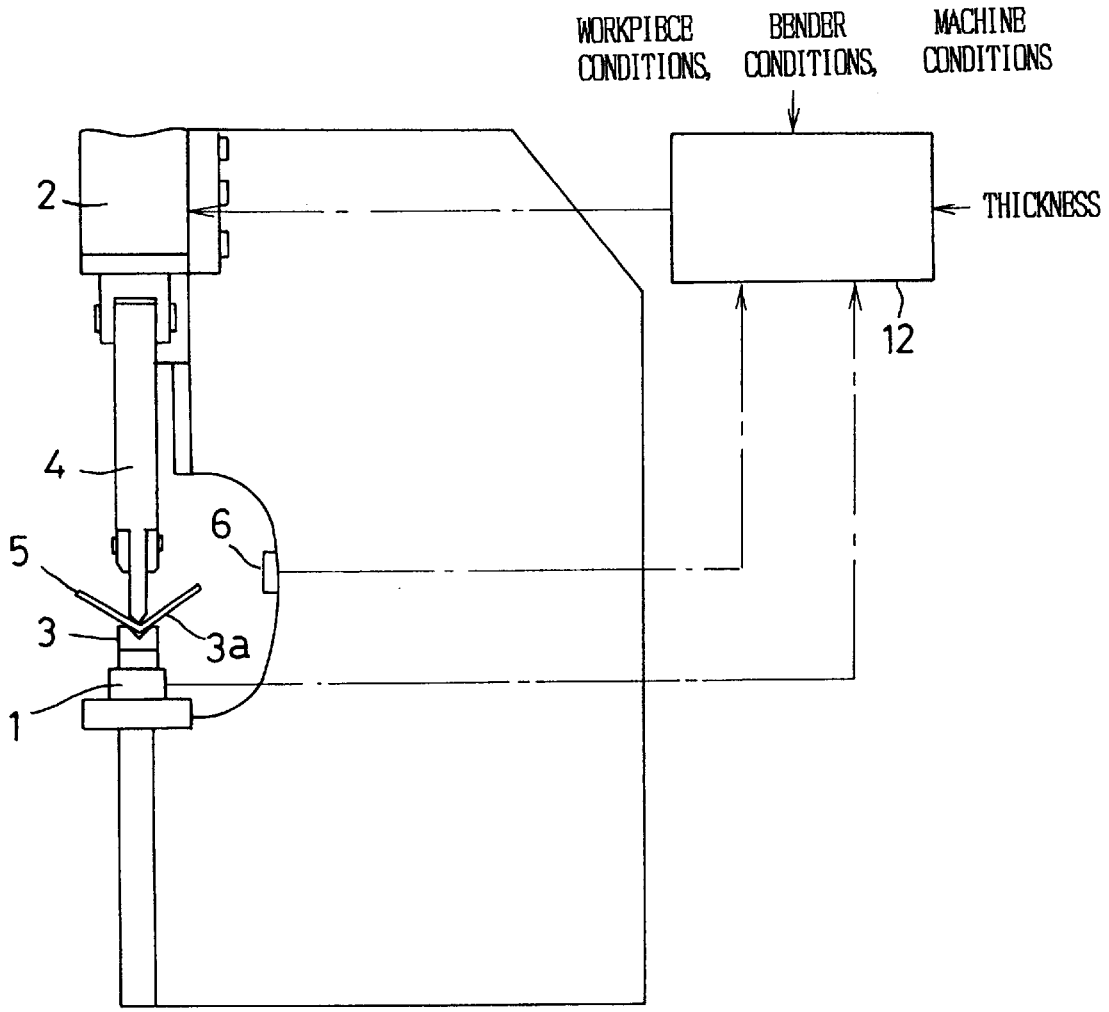

As shown in the system-structural diagram of FIG. 2, a press brake according to one embodiment of the invention includes a fixedly disposed, horizontal table 1 and a ram 2 which is lifted and lowered relative to the horizontal table 1. Positioned on the top face of the horizontal table 1 is a die (lower bender) 3 having a V-shaped die cavity (V-shaped groove) 3*a*. A punch (upper bender) 4 is attached to the bottom of the ram 2 at a position opposite to the die 3. Behind the die 3 and the punch 4, a buck-stop (not shown) is provided so as to be movable in forward, backward, vertical and lateral directions. A sheet-like workpiece (material to be processed) 5 is placed between the die 3 and the punch 4 to be bent by lowering the punch 4 to a position of specified level by means of the ram 2, with the rear edge of the workpiece 5 butted against the back-stop.

The above-described press brake has a strain gauge 6 attached to the side frame thereof and with this strain gauge 6, the strain of the side frame during bending of the workpiece 5 is detected. From the strain thus detected, the actual load exerted on the workpiece 5 during bending can be detected.

Figure 3:
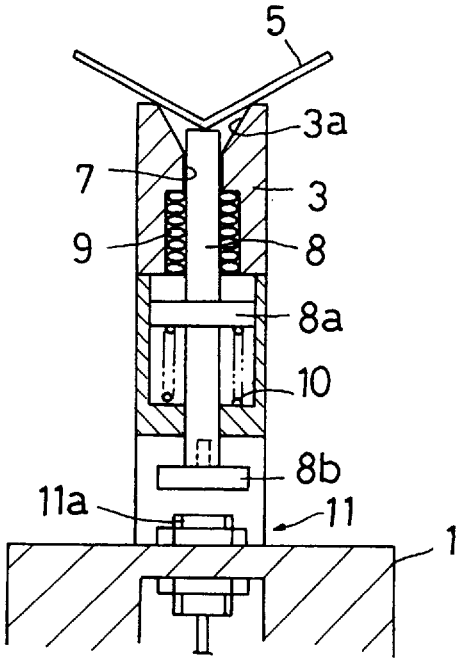

As shown in FIG. 3, a vertical hole 7 is pierced at the bottom of the V-shaped groove 3*a* of the die 3 and a position detecting pin 8 is inserted into the vertical hole 7 from the underpart of the die 3. The position detecting pin 8 is so guided as to slide freely in a vertical direction with the help of a ball bush 9 that is disposed in the lower part of the die 3. The position detecting pin 8 has, at the center thereof, a flange 8*a* which is so disposed as to come into contact with the bottom face of the die 3 and is biased upwards all times by means of the elastic force of a compression spring 10. The top face of the position detecting pin 8 is arranged at the same height as the top face of the die 3. The position detecting pin 8 has a cap 8*b* at its lower end, which has comparatively larger end face. Under the cap 8*b*, there is provided a displacement sensor 11 having a cylindrical sensor head 11*a* at a position opposite to the end face of the cap 8*b*. The displacement sensor 11 generates a high-frequency magnetic field by high-frequency current flowing into a coil housed in the sensor head 11*a*, and this magnetic field allows generation of eddy current at the surface of the cap 8*b* which serves as an object to be measured. The distance between the respective end faces of the cap 8*b* and sensor head 11*a* can be measured from the magnitude of the eddy current.

With the above construction, the workpiece 5 placed on the top face of the die 3 is bent by lowering of the punch 4 such that it plunges into the V-shaped groove 3*a*, pushing the position detecting pin 8 down. In turn, the position detecting pin 8 slides downwards within the vertical hole 7, against the biasing force of the compression spring 19. As the position detecting pin 8 slides downwards, the cap 8*b* also slides downwards so that the distance between the end face of the cap 8*b* and the end face of the sensor head 11*a* is reduced, increasing the eddy current generated at the surface of the cap 8*b*. With this arrangement, the plunging amount of the workpiece 5 into the V-shaped groove 3*a* is detected as the displacement of the workpiece 5.

In this manner, during bending of the workpiece 5, the actual load exerted on the workpiece 5 is detected by the strain gauge 6 and the displacement of the workpiece 5 is detected by the displacement sensor 11, and these pieces of data are input in an NC device 12. Workpiece conditions (material, bending length, bending angle etc.); bender conditions (height, the width of the V-shaped groove, V-angle, punch R, shoulder R etc.); and machine conditions (rigidity, speed specification, stroke specification etc.) are preliminarily input in the NC device 12 through a data input unit. Also, data on the thickness of the workpiece 5 obtained from actual measurement is manually input in the NC device 12.

The NC device 12 stores a sampling range for the actual load to displacement data and a data table which is used for determining machine control conditions. In this embodiment, yield stress is selected as the representative characteristic of the workpiece 5 to be bent, and the NC device 12 stores a yield stress to bending angle data table and also stores a bending angle correction amount to correction depth amount data table which are preliminarily input according to processing conditions. This is because yield stress is correlated with bending angles as shown in FIG. 4.

In the NC device 12, a reference depth amount for the ram 2 is first computed based on the input data such as the workpiece conditions, bender conditions and machine conditions, and then bending is performed according to the preset machine control conditions. During the bending operation, the relationship between bending stress and displacement is obtained from the sampling data on actual load to displacement obtained from the strain gauge 6 and the displacement sensor 11 and from the actual thickness of the workpiece 5. From the bending stress and displacement relationship thus obtained, yield stress which serves as the representative characteristic of the workpiece 5 is obtained.

Figure 5:
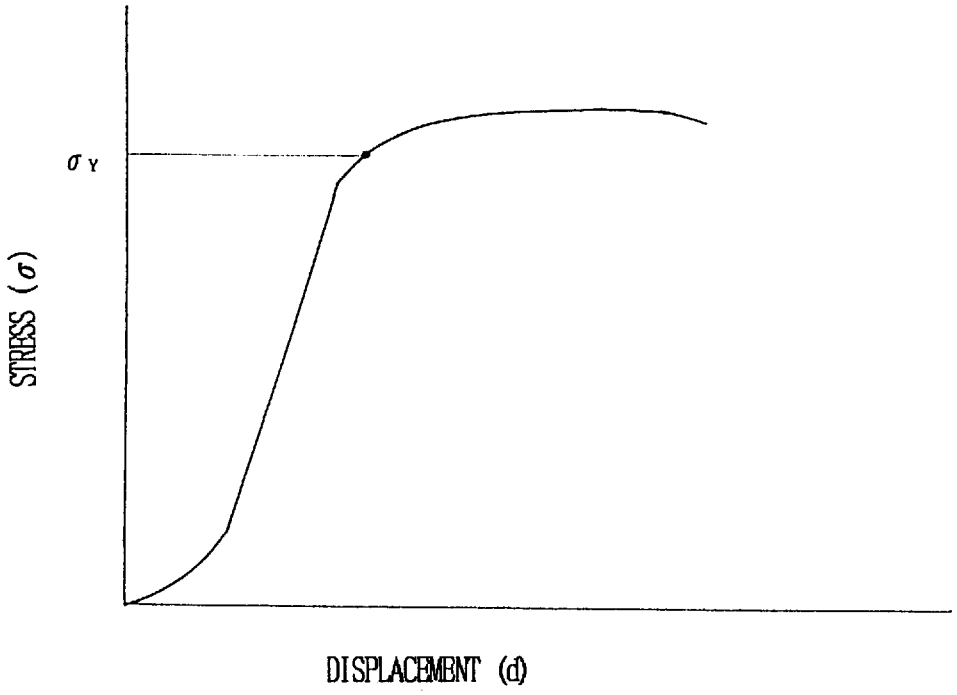
Figure 5:
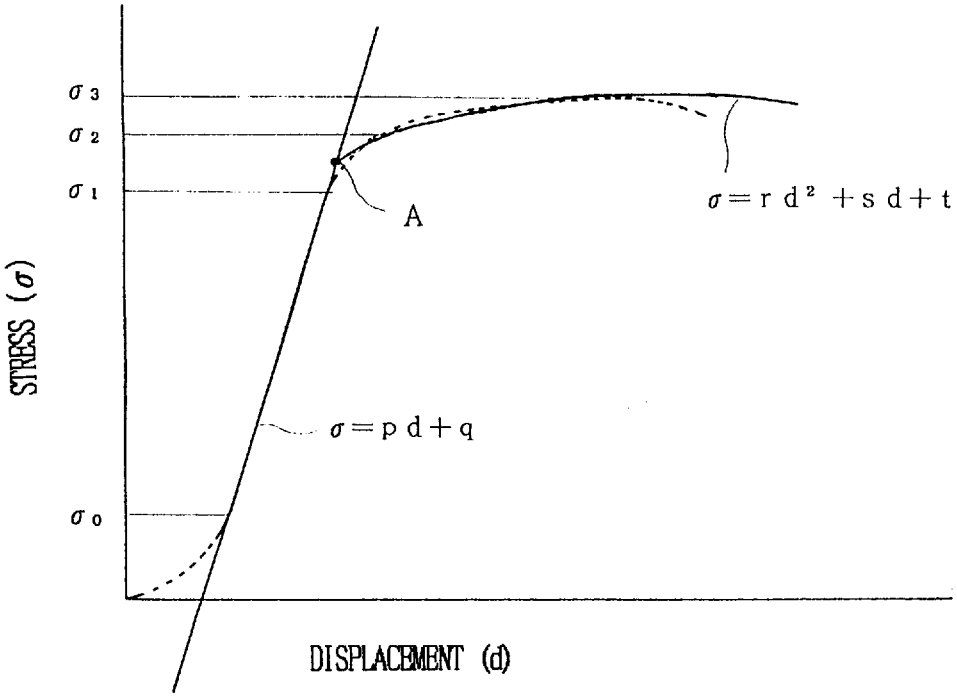

FIG. 5 shows one example of the method for obtaining yield stress from a stress to displacement curve. The yield stress $\sigma_Y$ shown in FIG. 5(*a*) is obtained in the following way. As shown in FIG. 5(*b*), the relationship between the stress $\sigma$ and the displacement d in the elastic range is approximated by the linear equation $\sigma=pd+q$ from the upper limit $\sigma_1$ and the lower limit $\sigma_0$ of the adopted data of stress $\sigma$, while the relationship between the stress $\sigma$ and the displacement d in the plastic range is approximated by the quadratic equation $\sigma=rd^2+sd+t$ from the upper limit $\sigma_3$ and lower limit $\sigma_2$ of the adopted data of stress $\sigma$. Then, the value of the stress at the intersection A of these approximate equations is determined as yield stress. It should be noted other methods than one shown in FIG. 5 may be used for obtaining yield stress. One example is such that the changing rate of the stress $\sigma$ is first calculated and then, when this changing rate comes below a specified value, the value of the stress at that point is determined as yield stress.

Figure 4:
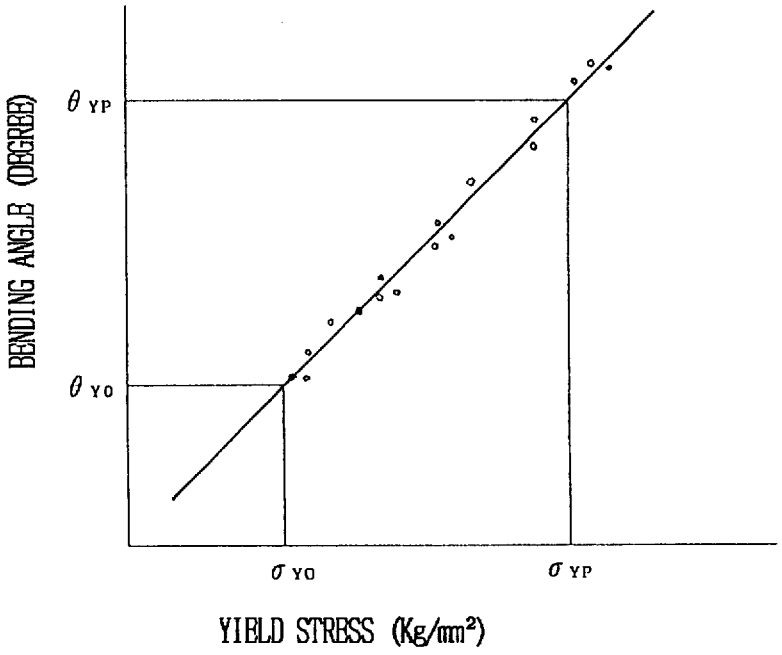

After obtaining a yield stress value in this manner, the yield stress to bending angle data table as shown in FIG. 4 is looked to obtain a bending angle correction amount $\theta_{Yp-Y0}$ that corresponds to the difference $\sigma_{Yp}-\sigma_{Y0}$ between the reference yield stress $\sigma_{Y0}$ and actual yield stress $\sigma_{Yp}$ which varies according to the material of the workpiece 5. Then, a correction depth amount is computed with reference to the bending angle correction amount to correction depth amount relationship and the correction depth amount thus obtained is added to the preset reference depth amount thereby obtaining a final depth amount according to which the ram 2 is operated.

While a bending angle correction amount is obtained from yield stress and a correction depth amount is then obtained from this bending angle correction amount in the foregoing description, it is also possible that a correction depth amount to yield stress data table is preliminarily stored and a correction depth amount can be obtained directly from this table.

Figure 6:
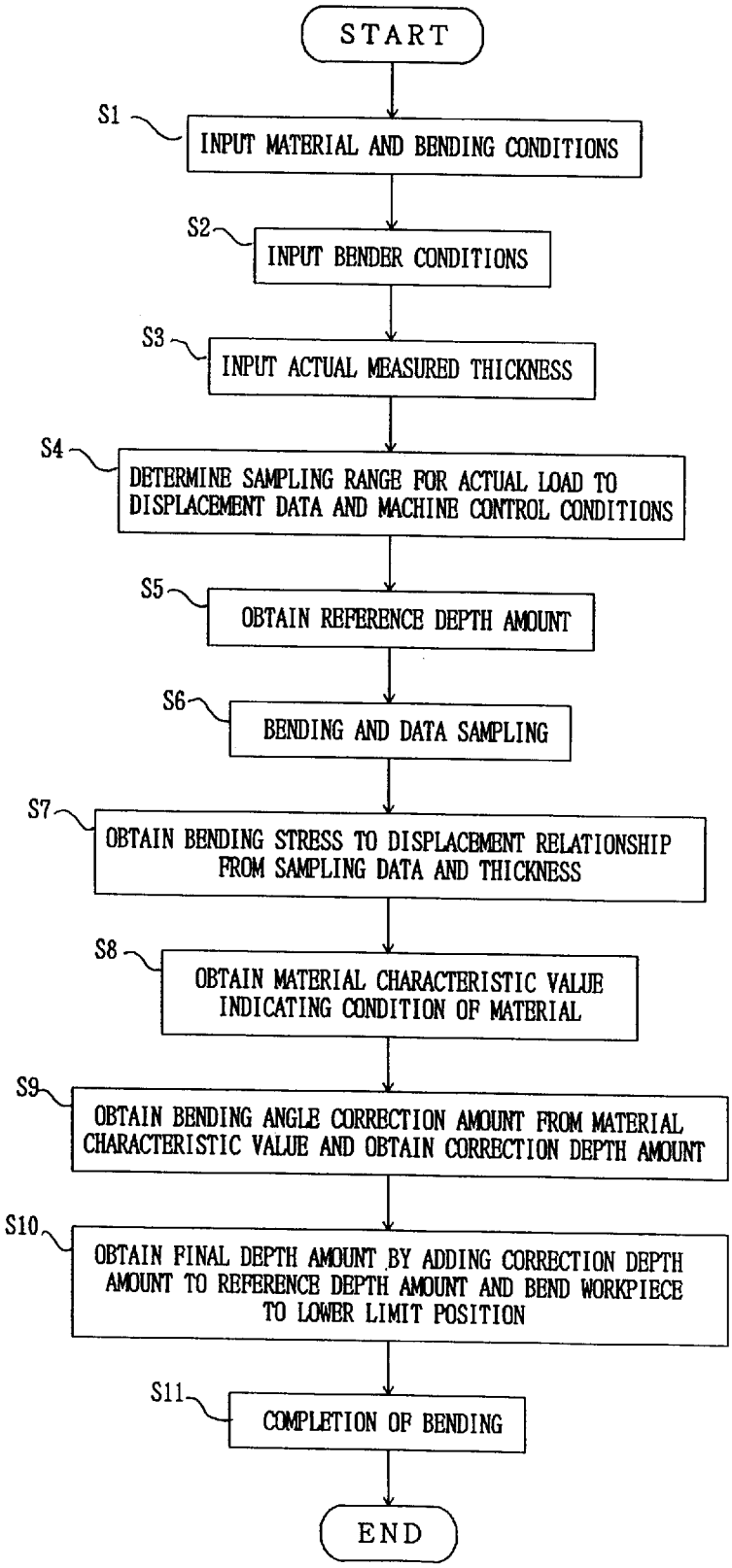

Now, the above control operation of the embodiment will be explained with reference to the flow chart of FIG. 6.

Step 1 to Step 3: Material and bending conditions (bending length, bending angle etc.) are input. Also, bender conditions (punch conditions (punch height, punch R, V-angle); die conditions (die height, V-width, V-angle, shoulder R)) and measured thickness are input.

Step 4: According to the given processing conditions, a sampling range (intervals, time, position etc.) for actual load to displacement data and machine control conditions are determined using a data base associated with sampling conditions and input data.

Step 5: A reference depth amount for the ram 2 is obtained through calculation based on the input data.

Step 6: Bending of the workpiece 5 is started. In the course of the bending operation, the actual load exerted on the workpiece 5 is detected with the strain gauge 6 and the displacement of the workpiece 5 is detected with the displacement sensor 11, thereby performing sampling operation to obtain actual load to displacement data. It should be noted that there is no need to perform data sampling throughout the region up to the reference lower limit of the ram 2.

Step 7 to Step 8: A bending stress to displacement relationship is obtained from the sampling data prepared in Step 6 and from the input data on the actual thickness of the workpiece 5. From the bending stress to displacement relationship, a material characteristic value which indicates the condition of the material being bent, for example, yield stress is obtained.

Step 9: With the material characteristic value obtained in Step 8, a bending angle correction amount is obtained, using the data table concerning the correlation between the material characteristic value and bending angles. Then, a correction depth amount is obtained from the bending angle correction amount.

Step 10: A final depth amount is obtained by adding the correction depth amount to the reference depth amount and the ram 2 is lowered to the ram lower limit position corresponding to the final depth amount to bend the workpiece 5.

Step 11: Bending is completed.

In this embodiment, the ram lower limit position is automatically corrected in accordance with a characteristic of the material of the workpiece 5 being bent whenever bending of a workpiece is performed. Therefore, even when the material of the workpiece 5 differs from that in previous bending, high-accuracy bending free from bending angle variations can be ensured.

Figure 7:
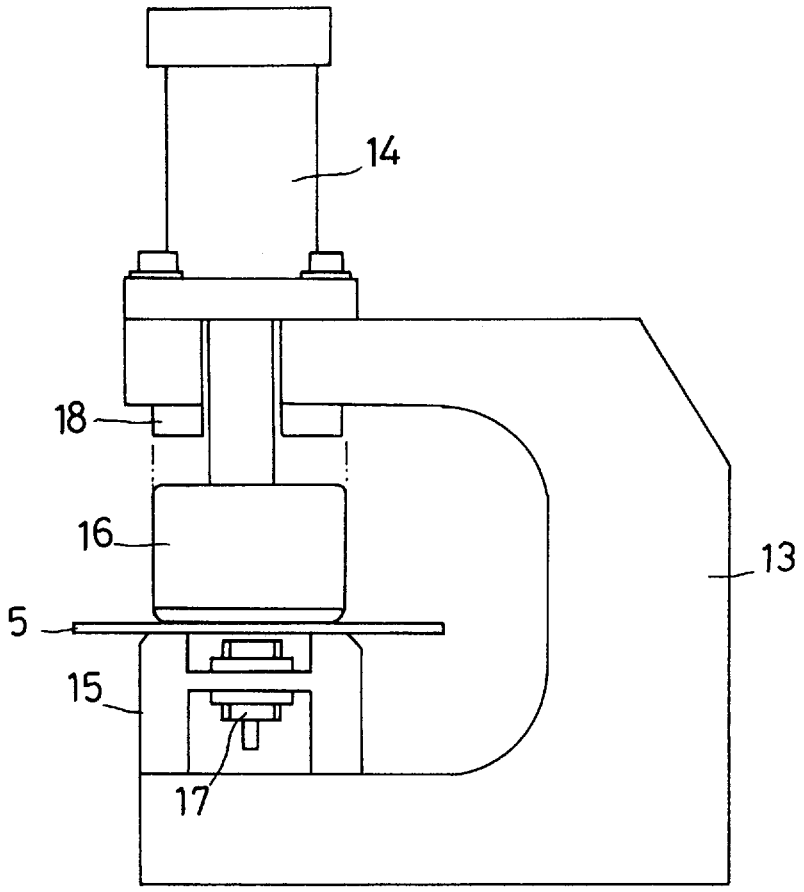

While thickness data on the workpiece 5 is manually input in this embodiment, the thickness may be measured by an automatic measuring device and the result of the measurement may be automatically input in the NC device 12. One example of such an automatic measuring device is shown in FIG. 7. As shown in this figure, the automatic measuring device includes an air cylinder 14 disposed on the upper part of a C-shaped frame 13 and a sensor block 15 disposed at the lower part of the same. The movement of the air cylinder 14 allows the workpiece 5, which is an object to be measured, to be held between a pressing pad 16 attached to the underpart of the air cylinder 14 and the top face of the sensor block 15. With the output of an eddy current sensor 17 positioned within the sensor block 15, the thickness of the workpiece 5 is measured. It should be noted that, reference numeral 18 in FIG. 7 denotes an urethane cushion used as cushioning material.

While the thickness of the workpiece 5 is input to obtain the bending stress to displacement relationship in this embodiment, another possible embodiment is such that a material characteristic value such as yield stress is obtained from the actual load to displacement relationship without taking the thickness of the workpiece 5 into account and a bending angle correction amount is obtained from this material characteristic value.

While the displacement data on the workpiece 5 during bending operation is obtained from the output of the displacement sensor 11 in this embodiment, the displacement data may be substituted by measurement time intervals (i.e., time data) in cases where the speed of lowering the ram 2 is controlled with high accuracy. In this case, actual load to time data is used instead of the actual load to displacement data.

Figure 8:
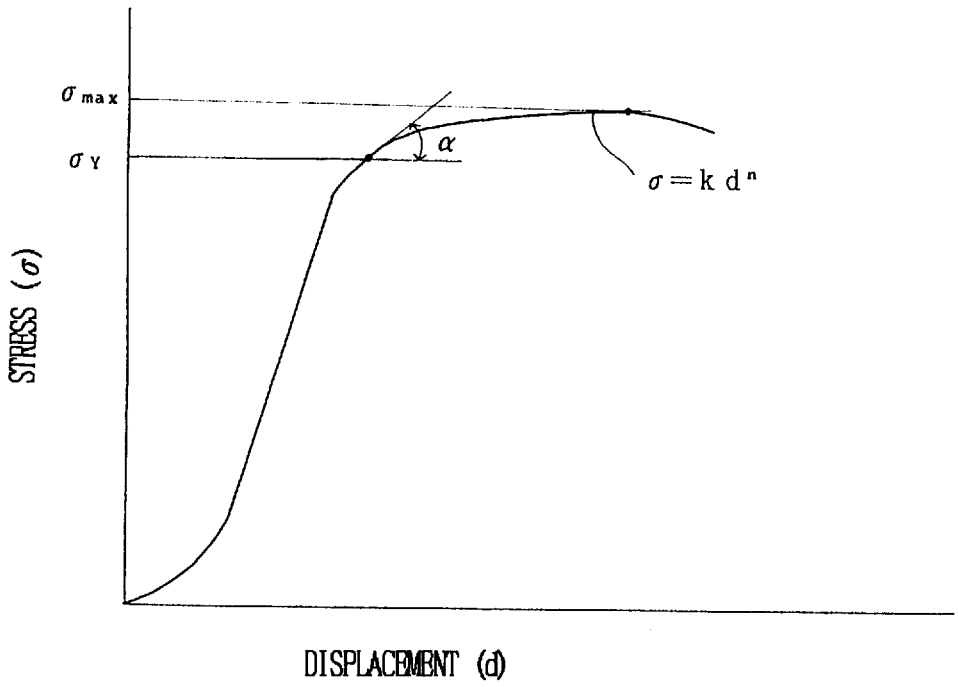

While yield stress is used as the material characteristic value of the workpiece 5 in this embodiment, the following material characteristic values may be used in place of yield stress (see FIG. 8).

(1) the ratio of yield stress $\sigma_Y$ to the maximum stress $\sigma_{max}$ ($\sigma_Y/\sigma_{max}$) or the ratio of yield stress to the maximum load In this case, the yield stress $\sigma_Y$ is obtained in the same manner as described earlier and the maximum stress $\sigma_{max}$ is estimated from the point at which the gradient of the linear equation $\sigma=rd^2+sd+t$ becomes zero, that is, the point at which the differential of $\sigma$ with respect to d is zero.

(2) the stress gradient $\alpha$ (or load gradient) in the plastic range The stress gradient $\alpha$ is obtained from the gradient of the straight line (linear equation) by which the stress to displacement curve in the plastic range is approximated.

(3) the exponent n of the stress to displacement curve (or load to displacement curve)

The exponent of the equation of n-th degree $\sigma=kd^n$ by which the stress to displacement curve is approximated is used as the material characteristic value.

Although the invention has been described with a case where a workpiece is bent by lowering the ram and the lower limit position for the ram is set, the invention is also applicable to cases where a workpiece is bent by lifting the ram and the upper limit position for the ram is set.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A ram position setting method for a press brake for bending a workpiece placed between a punch and die at a predetermined angle by reciprocating a ram between an upper limit position and a lower limit position, said method comprising the steps of:

obtaining a relationship between actual load exerted on the workpiece and displacement during bending of the workpiece;

obtaining one of yield stress and yield load as a specific material characteristic value that indicates a characteristic of the material of the workpiece from the actual load to displacement relationship; and setting one of said upper limit position and said lower limit position for the ram based on the correlation between the material characteristic value and bending angle.

2. A ram position setting method for a press brake for bending a workpiece placed between a punch and die at a predetermined angle by reciprocating a ram between an upper limit position and a lower limit position, said method comprising the steps of:

obtaining changes over time in actual load exerted on the workpiece during bending of the workpiece;

obtaining one of yield stress and yield load as a specific material characteristic value that indicates a characteristic of the material of the workpiece from these changes over time; and setting one of said upper limit position and said lower limit position for the ram based on the correlation between the material characteristic value and bending angle.

3. A ram control unit for a press brake for bending a workpiece placed between a punch and die at a predetermined angle by one of lifting a ram and lowering the ram, the ram control unit comprising:

(a) reference depth amount setting means for setting a reference depth amount for the punch according to processing data for the workpiece which has been input;

(b) actual load detecting means for detecting actual load exerted on the workpiece during bending operation;

(c) displacement detecting means for detecting the displacement of the workpiece during bending operation;

(d) material characteristic value computing means for computing actual load to displacement data during bending operation from the output of the actual load detecting means and from the output of the displacement detecting means and for computing, from the actual load to displacement data, one of yield stress and yield load as a specific material characteristic value which indicates a characteristic of the material of the workpiece being bent;

(e) correction depth amount computing means for computing, from the material characteristic value obtained by the material characteristic value computing means, a correction depth amount that corresponds to the material characteristic value;

(f) final depth amount computing means for computing a final depth amount for the punch by adding the correction depth amount obtained by the correction depth amount computing means to the reference depth amount; and (g) ram operating means for operation the ram based on the final depth amount obtained by the final depth amount computing means.

4. A ram control unit for a press brake for bending a workpiece placed between a punch and die at a predetermined angle by one of lifting a ram and lowering the ram, the ram control unit comprising:

(a) reference depth amount setting means for setting a reference depth amount for the punch according to processing data for the workpiece which has been input;

(b) actual load detecting means for detecting actual load exerted on the workpiece during bending operation at specified time intervals;

(c) material characteristic value computing means for computing changes with time in the actual load during bending operation from the output of the actual load detecting means, and for computing, from said changes with time in the actual load, one of yield stress and yield load as a specific material characteristic value which indicates a characteristic of the material of the workpiece bent;

(d) correction depth amount computing means for computing, from the material characteristic value obtained by the material characteristic value computing means, a correction depth amount that corresponds to the material characteristic value;

(e) final depth amount computing means for computing a final depth amount for the punch by adding the correction depth amount obtained by the correction depth amount computing means to the reference depth amount; and (f) ram operating means for operating the ram based on the final depth amount obtained by the final depth amount computing means.

5. A ram control unit for a press brake for bending a workpiece placed between a punch and die at a predetermined angle by one of lifting a ram and lowering the ram, the ram control unit comprising:

(a) reference depth amount setting means for setting a reference depth amount for the punch according to processing data for the workpiece which has been input;

(b) actual load detecting means for detecting actual load exerted on the workpiece during bending operation;

(c) displacement detecting means for detecting the displacement of the workpiece during bending operation;

(d) material characteristic value computing means for computing actual load to displacement data during bending operation from the output of the actual load detecting means and from the output of the displacement detecting means; for computing bending stress to displacement data during bending operation from the actual load to displacement data and from preliminarily input thickness data on the workpiece; and for computing, from the bending stress to displacement data, one of yield stress and yield load as a specific material characteristic value which indicates a characteristic of the material of the workpiece being bent;

(e) correction depth amount computing means for computing, from the material characteristic value obtained by the material characteristic value computing means, a correction depth amount that corresponds to the material characteristic value;

(f) final depth amount computing means for computing a final depth amount for the punch by adding the correction depth amount obtained by the correction depth amount computing means to the reference depth amount; and (g) ram operating means for operating the ram based on the final depth amount obtained by the final depth amount computing means.

6. A ram control unit for a press brake for bending a workpiece placed between a punch and die at a predetermined angle by one of lifting a ram and lowering the ram, the ram control unit comprising:

(a) reference depth amount setting means for setting a reference depth amount for the punch according to processing data for the workpiece which has been input;

(b) actual load detecting means for detecting actual load exerted on the workpiece during bending operation at specified time intervals;

(c) material characteristic value computing means for computing changes with time in the actual load during bending operation from the output of the actual load detecting means, for computing changes over time in bending stress during bending operations from the changes over time in the actual load and from preliminarily input thickness data on the workpiece, and for computing, from the changes over time in the bending stress, one of yield stress and yield load as a specific material characteristic value which indicates a characteristic of the material of the workpiece being bent;

(d) correction depth amount computing means for computing, from the material characteristic value obtained by the material characteristic value computing means, a correction depth amount that corresponds to the material characteristic value;

(e) final depth amount computing means for computing a final depth amount for the punch by adding the correction depth amount obtained by the correction depth amount computing means to the reference depth amount; and (f) ram operating means for operating the ram based on the final depth amount obtained by the final depth amount computing means.

7. The ram control unit for a press brake as claimed in claim 5 or 6, wherein said thickness data is a measured value obtained by an automatic thickness measuring device.

8. The ram control unit for a press brake as claimed in any one of claims 3, 4, 5 or 6, wherein the correction depth amount computing means is designed to calculate a bending angle correction amount from the material characteristic value obtained by the material characteristic value computing means and to calculate a correction depth amount from the bending angle correction amount.

* * * * *

UNITED STATES PATENT AND TRADEMARK OFFICE

CERTIFICATE OF CORRECTION

PATENT NO. : 5,813,263

DATED : September 29, 1998

INVENTOR(S) : Tokai

It is certified that error appears in the above-identified patent and that said Letters Patent is hereby corrected as shown below:

On the title page item [63], after "abandoned" insert -- ; Filed as PCT/JP94/01734, 10/14/94. --

Signed and Sealed this

Seventeenth Day of August, 1999

*Attest:*

Q. TODD DICKINSON

*Attesting Officer*

*Acting Commissioner of Patents and Trademarks*